US011287766B2

(12) United States Patent
Tatezawa et al.

(10) Patent No.: US 11,287,766 B2
(45) Date of Patent: Mar. 29, 2022

(54) FIXING UNIT, IMAGE FORMING APPARATUS AND IMAGE FORMING SYSTEM

(71) Applicant: CANON KABUSHIKI KAISHA, Tokyo (JP)

(72) Inventors: Hidekazu Tatezawa, Soka (JP); Youichi Chikugo, Abiko (JP); Rikiya Takemasa, Kashiwa (JP); Kenichi Tanaka, Ushiku (JP); Yutaro Tsuno, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/748,126

(22) Filed: Jan. 21, 2020

(65) Prior Publication Data

US 2020/0233354 A1 Jul. 23, 2020

(30) Foreign Application Priority Data

Jan. 22, 2019 (JP) ..... 2019-008760

(51) Int. Cl.
*G03G 15/20* (2006.01)

(52) U.S. Cl.
CPC ..... *G03G 15/2053* (2013.01); *G03G 15/2032* (2013.01); *G03G 15/2064* (2013.01); *G03G 2215/2038* (2013.01)

(58) Field of Classification Search
CPC ..... G03G 15/2053; G03G 15/2064; G03G 15/2032; G03G 2215/2038
See application file for complete search history.

(56) References Cited

U.S. PATENT DOCUMENTS 4,475,804 A * 10/1984 Kanno ..... G03G 15/2028 271/311
5,315,359 A * 5/1994 Nishikawa ..... G03G 15/2028 271/308
5,826,141 A * 10/1998 Mitsuya ..... G03G 15/2064 399/122
6,697,589 B1 * 2/2004 Dunning ..... G03G 21/1647 399/107
7,890,038 B2 2/2011 Chikugo et al.
8,280,289 B2 * 10/2012 Yamanaka ..... G03G 15/2035 399/122
9,069,299 B2 6/2015 Tanaka
9,141,056 B2 * 9/2015 Yamamoto ..... G03G 15/2028
(Continued)

FOREIGN PATENT DOCUMENTS

JP 2004-286774 A 10/2004

*Primary Examiner* — G.M. A Hyder
(74) *Attorney, Agent, or Firm* — Venable LLP

(57) ABSTRACT

A fixing unit includes a casing, a heating unit, a second rotary member, a first guide portion, a separation unit, and a separation unit movement mechanism. The separation unit has a separation member and movable relative to the casing between a first position at which the separation unit is positioned when the heating unit is positioned at a position to form a fixing nip portion, and a second position at which the separation unit is positioned when the heating unit is retracted from the position to form the fixing nip portion. The separation unit movement mechanism is configured to move the separation unit from the second position to the first position with the heating unit mounting to the position to form the fixing nip portion.

24 Claims, 14 Drawing Sheets

(56) References Cited

U.S. PATENT DOCUMENTS

| | | | | |
|---|---|---|---|---|
| 9,354,562 | B2 | 5/2016 | Tanaka | |
| 9,367,006 | B2 | 6/2016 | Yoshida et al. | |
| 2006/0275060 | A1* | 12/2006 | Park | G03G 15/2028 399/323 |
| 2009/0010680 | A1* | 1/2009 | Nanno | G03G 15/20 399/122 |
| 2014/0153965 | A1* | 6/2014 | Nanno | G03G 21/1685 399/122 |
| 2017/0153581 | A1 | 6/2017 | Chikugo | |
| 2018/0067431 | A1* | 3/2018 | Nanno | G03G 15/2064 399/122 |
| 2021/0141322 | A1* | 5/2021 | Tatezawa | G03G 15/2057 |
| 2021/0191298 | A1* | 6/2021 | Takemasa | G03G 15/2064 |

* cited by examiner

FIXING UNIT, IMAGE FORMING APPARATUS AND IMAGE FORMING SYSTEM

BACKGROUND OF THE INVENTION

Field of the Invention

The present invention relates to a fixing unit for fixing toner image transferred to a recording material in an image forming apparatus such as an electrophotographic system and an electrostatic recording system, an image forming apparatus, and an image forming system.

Description of the Related Art

Hitherto, in an image forming apparatus adopting an electrophotographic system, electrostatic latent image formed on a photosensitive drum serving as an image bearing member is developed by toner as a toner image, in a developing unit, and the toner image is transferred to a recording material and then fixed to the recording material at a fixing unit. The fixing unit includes, for example, a heating rotary member, i.e., first rotary member, such as a fixing film, and a pressure rotary member, i.e., second rotary member, such as a pressure roller, between which a fixing nip portion is formed, and the recording material is heated and pressed at the fixing nip portion, by which unfixed toner image is fixed to the recording material. Further, in such a fixing unit, a contact-type or a non-contact-type separation member for separating a sheet adhered to the heating rotary member after the sheet has passed through the fixing nip portion is known to be provided on a downstream side in a sheet conveyance direction of a heating unit including the heating rotary member and a heater.

Such a separation member is generally required to be positioned and attached with high accuracy on the heating rotary member, so that a fixing unit is widely used where the separation member or a separation unit including the separation member is provided on the heating unit. Meanwhile, from the viewpoint of cost reduction, a fixing unit is also widely used where the separation unit is arranged outside the heating unit, such as on a frame member of the fixing unit, so that the cost of the separation member is not counted in a replacement cost of the heating unit. In such case, a separation member drop-out-prevention unit is proposed, which enables to maintain the separation member in a state retreated from the respective rotary members when replacing the heating rotary member or the pressure rotary member so as to prevent the separation member from interfering when replacing the heating unit (refer to Japanese Patent Application Laid-Open Publication No. 2004-286774).

However, according to the fixing unit disclosed in the above-mentioned Japanese Patent Application Laid-Open Publication No. 2004-286774, a jig is required for retreating the separation member when replacing the heating unit, so that it is difficult to reduce the number of components, and the jig must be assembled to the separation member, so that it is difficult to reduce the number of processing steps.

The present invention provides a fixing unit, an image forming apparatus and an image forming system capable of suppressing the number of components and processing steps without deteriorating the positional accuracy of the separation member with respect to the heating unit.

SUMMARY OF THE INVENTION

According to one aspect of the present invention, a fixing unit configured to fix an unfixed toner image formed at an image forming unit to a recording material includes a casing, a heating unit configured to be detachably attached to the casing and comprising a first rotary member configured to contact and heat the recording material, a second rotary member configured to contact the first rotary member and form a fixing nip portion with the first rotary member for conveying the recording material, a first guide portion configured to guide the heating unit from a contact start position to an attachment position so that the first rotary member is positioned at a position where the first rotary member forms the fixing nip portion with the second rotary member in a state where the heating unit is attached to the casing, a separation unit having a separation member and movable relative to the casing between a first position at which the separation unit is positioned when the heating unit is positioned at a position to form the fixing nip portion and a second position at which the separation unit is positioned when the heating unit is retracted from the position to form the fixing nip portion, and a separation unit movement mechanism configured to move the separation unit from the second position to the first position with the heating unit mounting to the position to form the fixing nip portion.

Further features of the present invention will become apparent from the following description of exemplary embodiments with reference to the attached drawings.

DESCRIPTION OF THE EMBODIMENTS

First Embodiment

Now, a first embodiment of a present invention will be described in detail with reference to FIGS. 1 to 9B. In the present embodiment, a tandem-type full-color printer is described as an example of an image forming apparatus 1. However, the present invention is not limited to application to a tandem-type image forming apparatus 1, and it can be applied to other types of image forming apparatuses, or to a monochrome or mono-color apparatus instead of a full-color apparatus. Further, it can be applied to apparatuses having various uses, such as a printer, various printing machines, a copying machine, a facsimile, a multifunction machine and so on.

Figure 1:
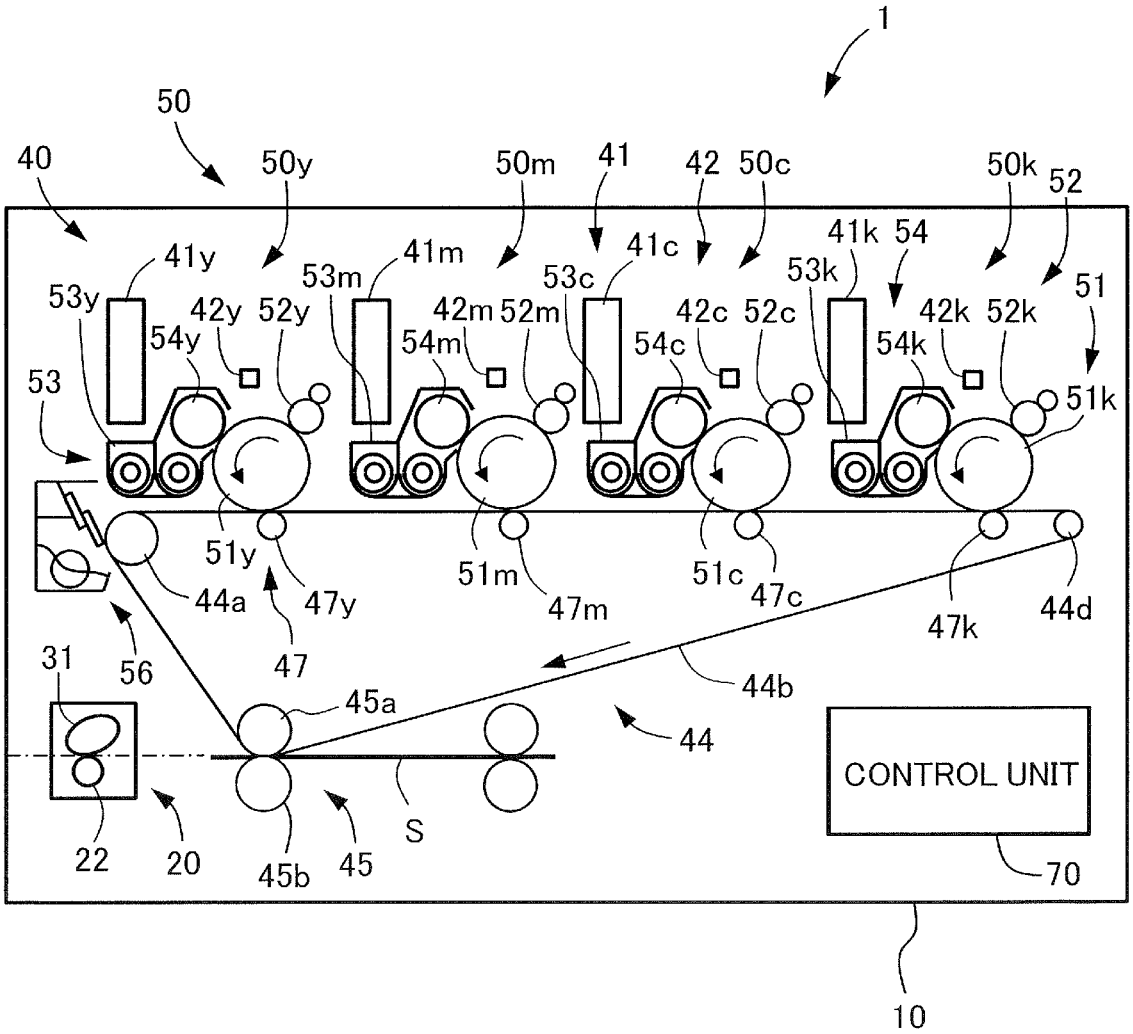
FIG. 1 is a cross-sectional view illustrating an overall configuration of an image forming apparatus according to a first embodiment.

As illustrated in FIG. 1, the image forming apparatus 1 includes an apparatus body 10, a sheet feeding unit not shown, an image forming unit 40, and a control unit 70. The image forming apparatus 1 can form a four-color full-color image on a recording material according to image signals received from a document reading apparatus not shown, a host device such as a personal computer, or an external device such as a digital camera or a smartphone. Actual examples of a sheet S serving as a recording material to which a toner image is formed include normal paper, synthetic resin sheet serving as a substitute of normal paper, thick paper, OHP sheet, and so on.

Image Forming Unit

The image forming unit 40 can form an image based on image information as unfixed toner image on the sheet S supplied from the sheet feeding unit. The image forming unit 40 includes image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing unit 20. The image forming apparatus 1 according to the present embodiment corresponds to full-color images, and the image forming units 50*y*, 50*m*, 50*c* and 50*k* having a similar configuration are provided separately for each of the four colors, which are yellow (y), magenta (m), cyan (c) and black (k). In the following description, the image forming unit 50*y* corresponding to yellow is described as a representing example.

The image forming unit 50*y* includes a photosensitive drum 51*y* that bears a toner image and moves, a charging roller 52*y*, a developing unit 53*y*, and a cleaning blade not shown. The image forming unit 50*y* serving as a process cartridge is formed integrally as a unit, attached in a detachable manner to the apparatus body 10, and forms a toner image on an intermediate transfer belt 44*b* described later.

The photosensitive drum 51*y* is rotatable, and bears an electrostatic latent image used for forming image. According to the present embodiment, the photosensitive drum 51*y* is an organic photoreceptor (OPC) having negative chargeability with an outer diameter of 30 mm, which is driven to rotate by a motor not shown in the direction of an arrow at a predetermined process speed, i.e., peripheral speed. The charging roller 52*y* utilizes a rubber roller that contacts the surface of the photosensitive drum 51*y* and is driven to rotate, charging a surface of the photosensitive drum 51*y* uniformly. The exposing unit 42*y* is a laser scanner that emits laser beams according to an image information of separated colors output from the control unit 70.

The developing unit 53*y* includes a developing sleeve 54*y*, and in a state where developing bias is applied, the electrostatic latent image formed on the photosensitive drum 51*y* is developed by toner. The developing unit 53*y* stores developer supplied from the toner bottle 41*y* and develops the electrostatic latent image formed on the photosensitive drum 51*y*. The developing sleeve 54*y* is formed of a nonmagnetic material such as aluminum and nonmagnetic stainless steel, and in the present embodiment, aluminum is used. A magnet roller in a shape of a roller is set in a fixed, non-rotatable manner with respect to a developer container in an inner side of the developing sleeve 54*y*. The developing sleeve 54*y* bears developer containing nonmagnetic toner and magnetic carrier and conveys developer to a developing area opposed to the photosensitive drum 51*y*.

The toner image developed on the surface of the photosensitive drum 51*y* is primarily transferred to the intermediate transfer unit 44. That is, the photosensitive drum 51*y* can bear toner image by supplying toner to the intermediate transfer belt 44*b*. After primary transfer, toner remaining on the photosensitive drum 51*y* without being transferred to the intermediate transfer unit 44 is removed by the cleaning blade provided in contact with the photosensitive drum 51*y*, and the photosensitive drum 51*y* prepares for the next image forming process.

The intermediate transfer unit 44 includes a plurality of rollers such as a driving roller 44*a*, a driven roller 44*d*, primary transfer rollers 47*y*, 47*m*, 47*c* and 47*k*, and an intermediate transfer belt 44*b* that is wound around these rollers and moves while bearing toner image. The driven roller 44*d* is a tension roller that controls the tension of the intermediate transfer belt 44*b* to a constant value. A force pressing the intermediate transfer belt 44*b* toward a surface side is applied to the driven roller 44*d* by an urging force of an urging spring not shown. The primary transfer roller 47*y* is arranged opposed to the photosensitive drum 51*y* in contact with the intermediate transfer belt 44*b*, and primarily transfers the toner image on the photosensitive drum 51*y* to the intermediate transfer belt 44*b*. That is, the intermediate transfer belt 44*b* bears the toner image and moves, that is, rotates.

The intermediate transfer belt 44*b* contacts the photosensitive drum 51*y* and forms a primary transfer portion with the photosensitive drum 51*y*, and when primary transfer bias is applied thereto, the toner image formed on the photosensitive drum 51*y* is primarily transferred at the primary transfer portion. By applying a primary transfer bias of positive polarity by the primary transfer roller 47*y* to the intermediate transfer belt 44*b*, the respective toner images having negative polarity on the photosensitive drum 51*y* are sequentially transferred in an overlapped manner to the intermediate transfer belt 44*b*. A belt cleaning apparatus 56 for cleaning transfer residual toner on the intermediate transfer belt 44*b* is provided on the intermediate transfer belt 44*b*.

The secondary transfer portion 45 includes a secondary transfer inner roller 45*a* and a secondary transfer outer roller 45*b*. The secondary transfer outer roller 45*b* contacts the intermediate transfer belt 44*b*, and a secondary transfer bias having opposite polarity as toner is applied to the nip portion formed between the intermediate transfer belt 44*b*. Thereby, the secondary transfer outer roller 45*b* secondarily transfers the toner image borne on the intermediate transfer belt 44*b* collectively to the sheet S supplied to the nip portion.

The fixing unit 20 includes a fixing belt 31 and a pressure roller 22. By having the sheet S nipped between the fixing belt 31 and the pressure roller 22 and conveyed to a sheet conveyance direction, toner image formed at the image forming unit 40 and transferred to the sheet S is heated, pressed, and fixed to the sheet S. The fixing unit 20 is driven by a drive motor M1 stored in the fixing unit 20 (refer to FIG. 2). The details of the fixing unit 20 will be described later.

Control Unit

Figure 2:
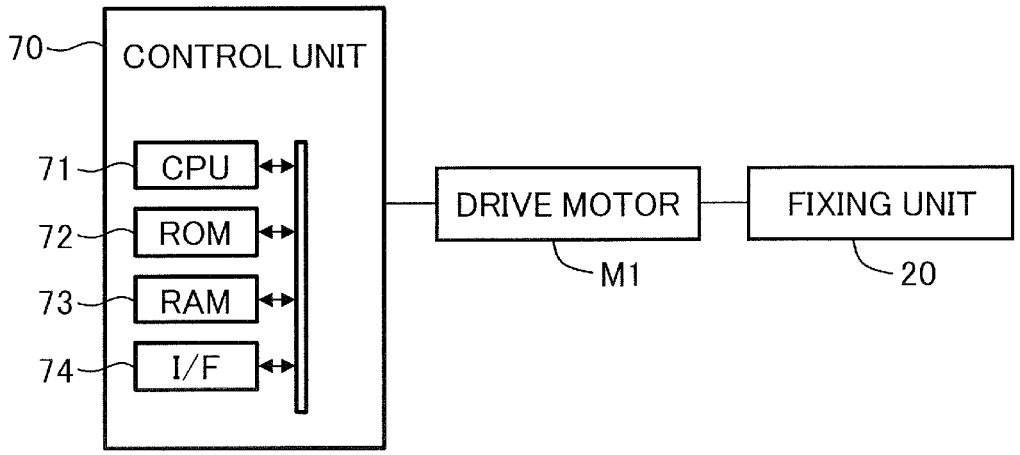
FIG. 2 is a control block diagram of the image forming apparatus according to the first embodiment.

As illustrated in FIG. 2, the control unit 70 is composed of a computer, and includes, for example, a CPU 71, a ROM 72 configured to store a program controlling the respective units, a RAM 73 configured to store data temporarily, and an input output circuit (I/F) 74 through which signals are entered from and output to an exterior. The CPU 71 is a microprocessor that performs overall control of the image forming apparatus 1, and it is a main subject of a system controller. The CPU 71 is connected via the input output circuit 74 to an operation unit, the sheet feeding unit, the image forming unit 40 and so on, communicating signals with the respective units and controlling operations thereof. The drive motor M1 of the fixing unit 20 is connected to the control unit 70, which controls the operation of the fixing unit 20. An image forming control sequence and the like for forming an image on the sheet S is stored in the ROM 72.

Image Forming Operation

Next, an image forming operation according to the image forming apparatus 1 configured as above is described. In a state where the image forming operation is started, at first, the photosensitive drum 51*y* is rotated and the surface thereof is charged by the charging roller 52*y*. Then, laser beam is irradiated from the exposing unit 42*y* to the photosensitive drum 51*y* based on image information, and an electrostatic latent image is formed on the surface of the photosensitive drum 51*y*. In a state where toner is attached to the electrostatic latent image, the image is developed and visualized as toner image, and transferred to the intermediate transfer belt 44*b*.

Meanwhile, in parallel with the toner image forming operation, the sheet S is supplied, and at a matched timing with the toner image on the intermediate transfer belt 44*b*, the sheet S is conveyed to the secondary transfer portion 45 through the conveyance path. Further, image is transferred from the intermediate transfer belt 44*b* to the sheet S, and the sheet S is conveyed to the fixing unit 20, where unfixed toner image is heated, pressed and fixed to the surface of the sheet S, and then discharged from the apparatus body 10.

Fixing Unit

Figure 3:
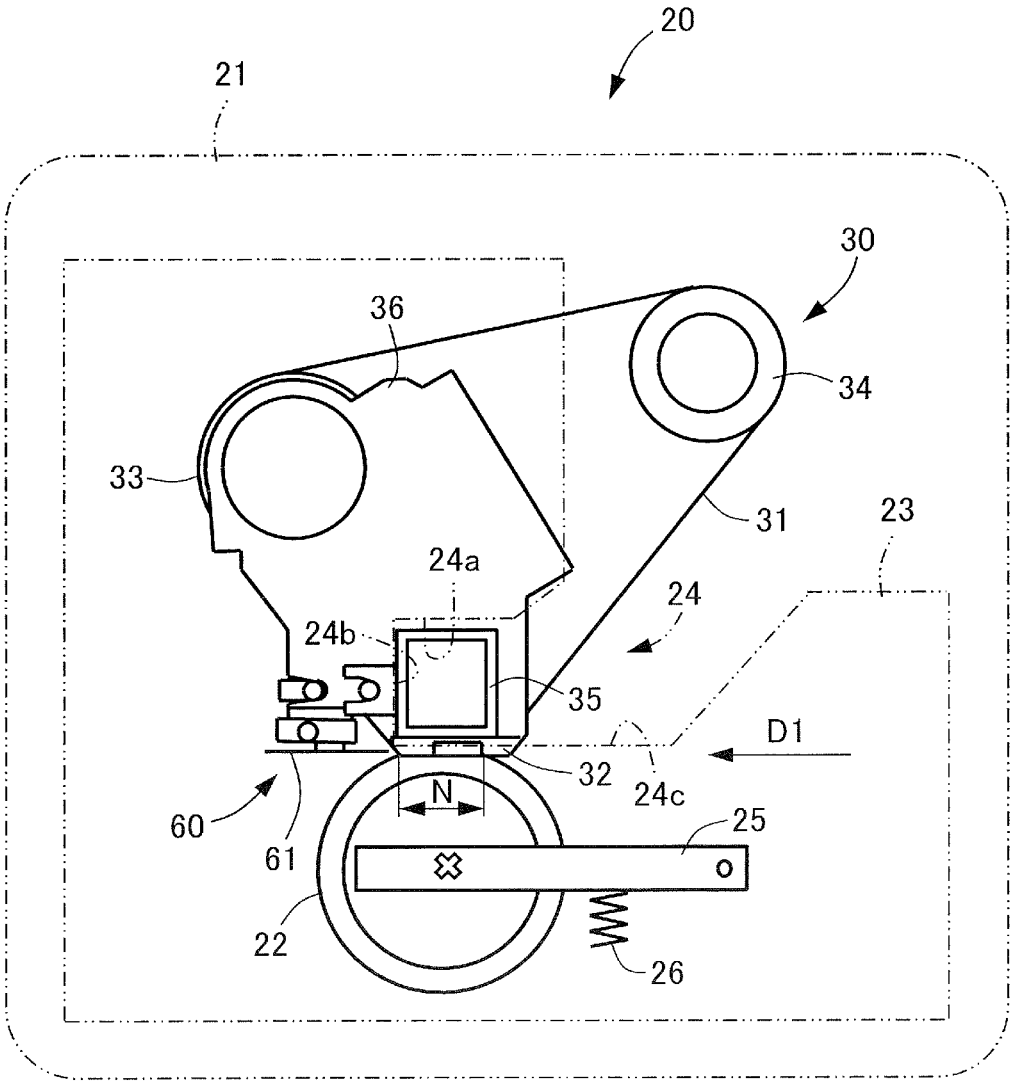
FIG. 3 is a cross-sectional view illustrating a fixing unit according to the first embodiment.

Next, the fixing unit 20 will be described in detail with reference to FIGS. 3 to 9B. As illustrated in FIG. 3, the fixing unit 20 is a belt-heating type heating apparatus, and it is in the form of a cartridge that can be detachably attached to the apparatus body 10 (refer to FIG. 1). The fixing unit 20 includes a casing 21, a heating unit 30, the pressure roller 22 serving as a second rotary member, and a separation unit 60. The heating unit 30 includes a fixing belt 31 serving as an endless rotatable first rotary member, a pressure pad 32 serving as a fixing member, a heating roller 33, a steering roller 34, a stay 35, and a unit side plate 36 that integrates these components as a cartridge.

The fixing belt 31 is a thin, cylindrical belt member having thermal conductivity and heat-resisting property, and it is capable of coming into contact with and heating the sheet S. In the present embodiment, the fixing belt 31 adopts a three-layer structure having a base layer, an elastic layer disposed on an outer circumference of the base layer, and a release layer formed on the outer circumference thereof. The base layer has a thickness of 30 μM and is formed of polyimide resin (PI), the elastic layer has a thickness of 300 μm and is formed of silicone rubber, and the release layer has a thickness of 30 μM and is formed of PFA as fluororesin. The fixing belt 31 is stretched across the pressure pad 32, the heating roller 33 and the steering roller 34.

The pressure pad 32 is pressed by the pressure roller 22 with the fixing belt 31 interposed therebetween. A fixing nip portion N is formed by a contact portion between the fixing belt 31 and the pressure roller 22. A lubricating sheet or a lubricant is interposed between the pressure pad 32 and the fixing belt 31, and the fixing belt 31 is designed to slide smoothly on the pressure pad 32.

The heating roller 33 is a stainless-steel pipe having a thickness of 1 mm, and having a halogen heater not shown disposed in an interior thereof, capable of being heated to a predetermined temperature. The fixing belt 31 is heated by the heating roller 33, and it is controlled to a predetermined target temperature determined for each sheet type based on detection of temperature by a thermistor. Further, a gear not shown is fixed to a first end portion of the heating roller 33 in the rotational axis direction, hereinafter also referred to as width direction W, and the heating roller 33 is connected to a drive gear M1 (refer to FIG. 2) through the gear and driven to rotate. The fixing belt 31 is driven to rotate by the rotation of the heating roller 33. The width direction W is a direction orthogonal to the conveyance direction of the sheet S passing through the fixing nip portion N.

The steering roller 34 has a pivot axis approximately extending in a vertical direction at a first end portion or an area near a center portion in the rotational axis direction, and in a state where the steering roller 34 pivots with respect to the fixing belt 31, tension difference is created in a main scanning direction, and the position of the fixing belt 31 in the main scanning direction can be adjusted. The steering roller 34 is urged by an urging force of an urging spring not shown supported on a frame of the heating unit 30, and it also serves as a tension roller that applies predetermined tension to the fixing belt 31.

The material of the pressure pad 32 is liquid crystal polymer (LCP), and the pressure pad 32 is supported by the stay 35 serving as a support member. The material of the stay 35 is stainless steel, and the stay 35 has both end portions thereof in the width direction W supported by a fixing frame 23 of the casing 21 of the fixing unit 20.

The pressure roller 22 is opposed to and in contact with the fixing belt 31, and forms the fixing nip portion N that is pressurized between the fixing belt 31. The pressure roller 22 is a roller having an elastic layer formed on an outer circumference of a shaft, and a release layer formed on an outer circumference of the elastic layer. The shaft is formed of stainless steel, the elastic layer has a thickness of 3 mm and is formed of conductive silicone rubber, and the release layer has a thickness of 30 μm and is formed of PFA serving as fluororesin. The pressure roller 22 is axially supported by the fixing frame 23 of the casing 21 of the fixing unit 20, and has a gear fixed to a first end portion in the rotational axis direction, and the pressure roller 22 is connected to the drive motor M1 (refer to FIG. 2) through the gear and driven to rotate.

A sheet on which toner image is borne is nipped at the fixing nip portion N formed between the fixing belt 31 and the pressure roller 22, where the sheet is conveyed while the toner image is heated. As described, the fixing unit 20 nips and conveys the sheet while fixing the toner image onto the sheet. Thus, it is necessary to realize both a function to apply heat and pressure to the sheet and a function to convey the sheet.

Fixing frames 23 are fixed to either side portions of the casing 21 with respect to the width direction W, and respectively include a guide portion, i.e., first guide portion, 24, a pressurizing frame 25, and a pressurizing spring 26. The stay 35 of the heating unit 30 is inserted to the guide portion 24, and it is fixed to the guide portion 24 by a fixing portion not shown. After fixing the stay 35 to the guide portion 24, the pressurizing frame 25 is moved toward the heating unit 30 by a drive source and a cam not shown, by which the pressure roller 22 is pressed against the pressing pad 32 through the fixing belt 31.

The guide portion 24 includes a supporting surface, i.e., supporting portion, 24*a*, a positioning surface, i.e., positioning portion, 24*b*, and a sliding surface 24*c*. That is, the casing 21 includes the supporting surface 24*a* and the positioning surface 24*b*. In FIG. 3, the heating unit 30 is positioned at the attachment position. The supporting surface 24*a* is formed along the sheet conveyance direction on an opposing side of the pressure roller 22, and in a state where the heating unit 30 is positioned at the attachment position, the fixing belt 31 supports the reaction force received from the pressure roller 22 at the inner circumference side of the fixing belt 31. The positioning surface 24*b* is formed approximately perpendicularly at a deepest portion in the direction in which the heating unit 30 is inserted in the guide portion 24, and in a state where the heating unit 30 is positioned at the attachment position, the positioning surface 24*b* is in contact with and positions the heating unit 30 in the inserting direction. The sliding surface 24*c* is formed in the sheet conveyance direction opposing to the supporting surface 24*a*, and when inserting or removing the heating unit 30, the stay 35 is slid on and guided by the sliding surface 24*c*. In a state where the heating unit 30 is attached to the casing 21, the guide portion 24 guides the heating unit 30 from a contact start position to the attachment position and attaches the heating unit 30 to position so that the fixing belt 31 is positioned at the fixing nip portion N. Further, the guide portion 24 guides the heating unit 30 from a guide start position on an outer side of the contact start position, and guides the heating unit 30 through the contact start position to the attachment position.

Separation Unit

Figure 4:
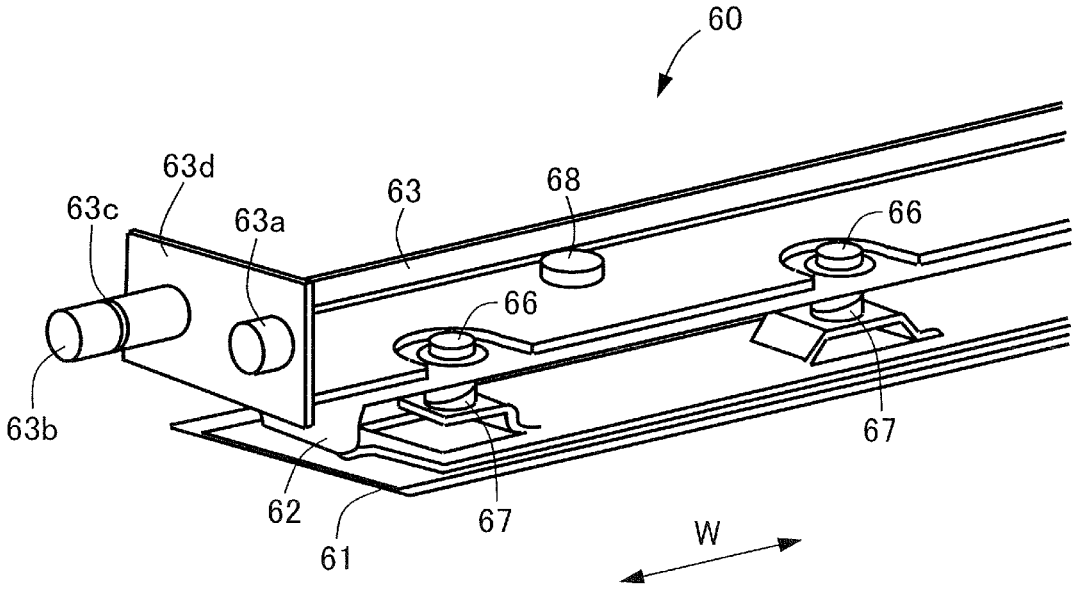
FIG. 4 is a perspective view illustrating a portion of a separation unit according to the first embodiment.

Next, the separation unit 60 serving as one example of the separation portion will be described in detail with reference to FIGS. 4 and 5. The separation unit 60 is provided on an outer side of the heating unit 30, that is, inside the fixing frame 23 of the fixing unit 20, for example (refer to FIG. 3). The separation unit 60 according to the present embodiment includes a separation plate, i.e., separation member, 61, a separation plate support member 62, a tension spring 65 serving as an urging portion, and a separation plate regulation member 63 that regulates the direction of movement of the separation plate 61. The separation plate 61 is formed of a metal plate, and a fluororesin tape that prevents toner adhesion from the sheet or damaging of image by sliding motion is attached. The separation plate support member 62 and the separation plate 61 are fastened by a separation plate fastening screw 66 and a compression spring 67, and thereby, the separation plate 61 and the separation plate support member 62 can adjust a positioning accuracy of a leading end of the separation plate 61 in the width direction W.

The separation plate regulation member 63 is fastened by the separation plate support member 62 and a screw 68, and functions together with a separation guide member 64 to restrict the direction of movement of the separation plate 61. The separation plate regulation member 63 has, on either side portions in the width direction W, a first guide shaft 63*a*, a second guide shaft 63*b*, and a spring hook portion 63*c* that locks a first end of the tension spring 65.

Meanwhile, the separation guide member 64 serving as a supporting unit includes the side surface portion 63*d*, a guide groove, i.e., second guide portion, 64*a* that is generally engaged with a first guide shaft, i.e., first engaged portion, 63*a* and a second guide shaft, i.e., second engaged portion, 63*b* that differs from the first guide shaft 63*a*, a spring hook portion 64*b* to which is hooked a second end of the tension spring 65, and a fastening portion 64*c* which is a fastening surface of the fixing frame 23. The side surface portion 63*d* is disposed approximately perpendicularly at both end portions in the width direction W. The first guide shaft 63*a* and the second guide shaft 63*b* are arranged in parallel in the sheet conveyance direction, extending toward the outer side from the side surface portion 63*d* with the width direction W corresponding to the axial center. That is, the separation guide member 64 is configured to support the separation unit 60 is provided at the casing 21.

The direction in which the separation plate 61 is moved by the first guide shaft 63*a* and the second guide shaft 63*b* of the separation plate regulation member 63 is determined by the guide groove 64*a* of the separation guide member 64. That is, the casing 21 includes the guide groove 64*a* that guides the first guide shaft 63*a* and the second guide shaft 63*b*. The separation unit 60 is moved between a movement start position and a fixed position described later by the first guide shaft 63*a* and the second guide shaft 63*b* being guided by the guide groove 64*a*. The tension spring 65 is arranged between the spring hook portion 64*b* fixed to the casing 21 and the second guide shaft 63*b*, and urges the second guide shaft 63*b* so as to urge the separation unit 60 to the movement start position described later. By locking the tension spring 65 to a direction approximately corresponding to the determined direction of movement, the direction of movement of the separation unit 60 can be set to correspond to the attaching and detaching directions of the heating unit 30. Here, a tension spring serves as the urging portion, but the present invention is not limited to this example, and for example, a torsion spring or a compression spring can be used as the urging portion to achieve an equivalent effect. Further, the urging portion can be provided on an outer side of the separation unit 60, for example, on the fixing frame 23.

Separation Positioning Portion of Heating Unit

Figure 6:
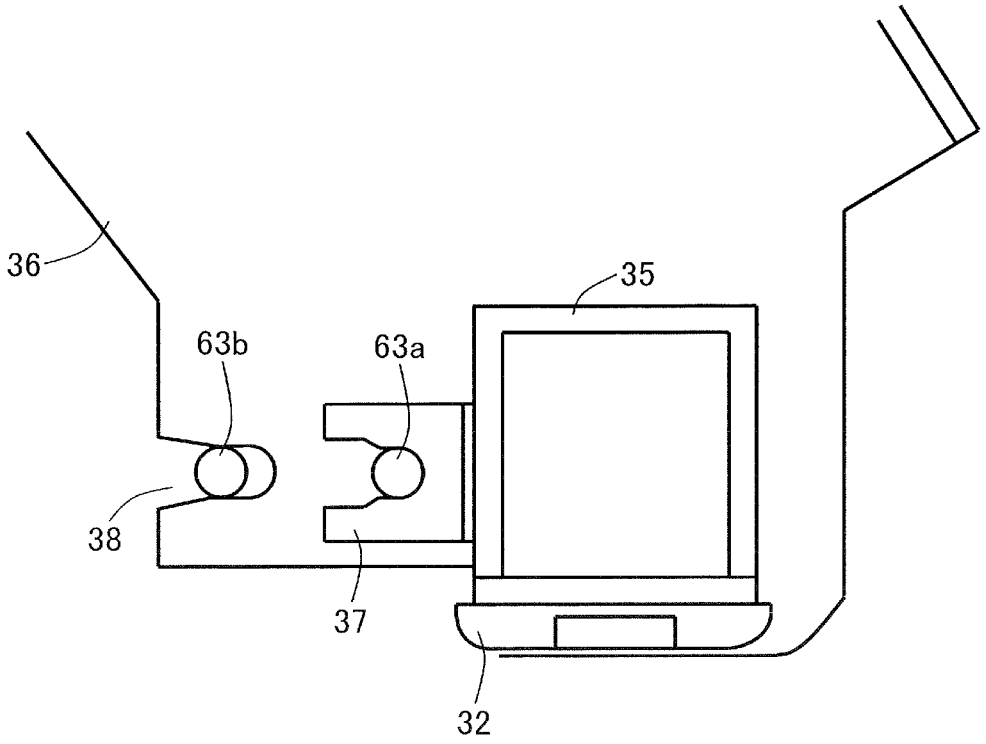
FIG. 6 is a side view illustrating a positioning portion of a heating unit and a separation unit according to the first embodiment.

Next, a positioning shape of the separation plate 61 provided on the heating unit 30 will be described in detail with reference to FIG. 6. A first separation positioning portion, i.e., first engagement portion, 37 and a second separation position portion, i.e., second engagement portion, 38 that differs from the first separation positioning portion 37 which respectively serve as positioning shapes of the separation plate 61 are provided on the stay 35 and the unit side plate 36. The first separation positioning portion 37 formed on the stay 35 can engage with the first guide shaft 63*a* of the separation unit 60. The second separation positioning portion 38 formed on the unit side plate 36 can engage with the second guide shaft 63*b* of the separation unit 60. The position of the separation unit 60 with respect to the fixing belt 31 can be determined by the above-described engagements. Actually, the area where the first guide shaft 63*a* and the first separation positioning portion 37 are engaged serves as an abutment, and the area where the second guide shaft 63*b* and the second separation positioning portion 38 are engaged serves as a rotation stopper. Thereby, positioning of the separation unit 60 and the stay 35 is enabled. That is, in a state where the heating unit 30 is moved from the contact start position to the attachment position, the first separation positioning portion 37 engages with the first guide shaft 63*a* and moves the separation unit 60 from the movement start position to the fixed position as described later. The second separation positioning portion 38 engages with the second guide shaft 63*b* in a state where the heating unit 30 is guided by the guide portion 24 from the contact start position to the attachment position, and stops rotation of the heating unit 30 with respect to the separation unit 60 in a direction of rotation with the center of rotation set at the width direction W.

Figure 5:
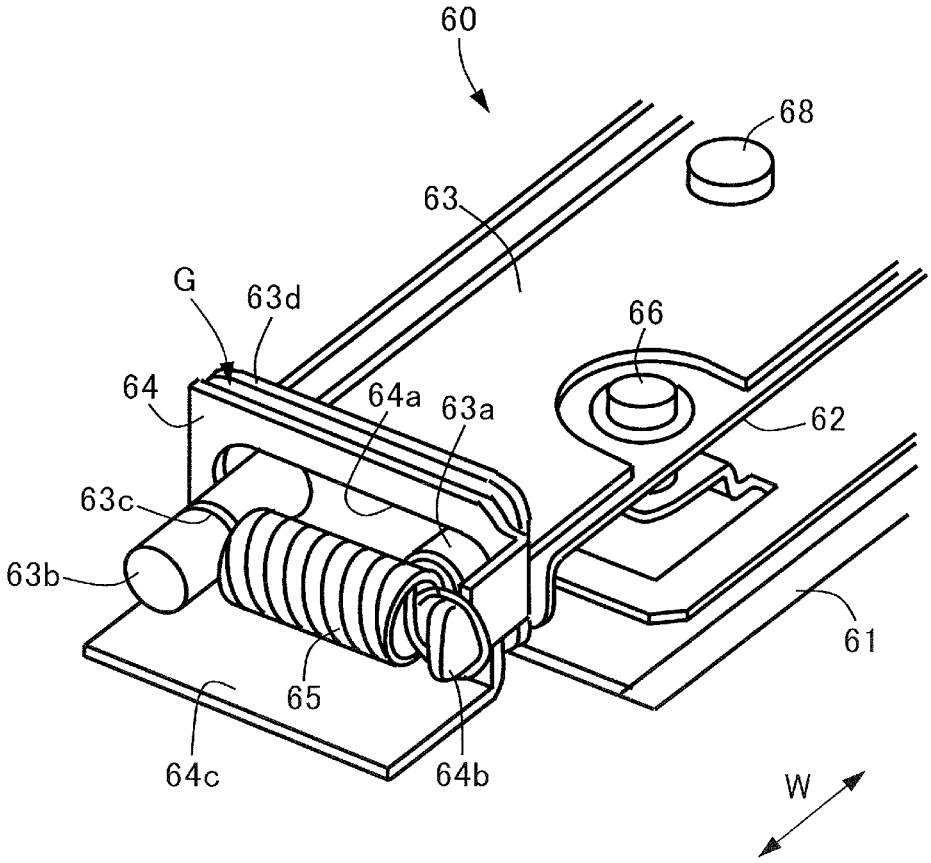
FIG. 5 is a perspective view illustrating a different portion of the separation unit according to the first embodiment.

Specifically, as illustrated in FIG. 5, a gap G is formed between the separation guide member 64 and the side surface portion 63*d*. In a state where the first separation positioning portion 37 (refer to FIG. 6) enters this gap G, the first separation positioning portion 37 can engage with the first guide shaft 63*a*, and further, in a state where the second separation positioning portion 38 (refer to FIG. 6) enters the gap, the second separation positioning portion 38 can engage with the second guide shaft 63*b*. Further, the state of engagement of the first separation positioning portion 37 and the first guide shaft 63*a* and the state of engagement of the second separation positioning portion 38 and the second guide shaft 63*b* are not limited to the configuration illustrated above, and any other appropriate configurations can be adopted.

Direction of Insertion and Removal of Heating Unit, and Direction of Movement of Separation Plate Next, a direction of insertion and removal of the heating unit 30 and a direction of movement of the separation plate 61 will be described in detail with reference to FIGS. 7A to 8B. In a state where the heating unit 30 is inserted to the guide portion 24 from a state illustrated in FIG. 7A to a state illustrated in FIG. 7B, or in a state where it is drawn out in the opposite direction, the direction of insertion and removal thereof is regulated by the sliding surface 24*c* and the supporting surface 24*a*. The direction of insertion of the heating unit 30 is referred to as a heating unit insertion direction D1, wherein D1 is set to be parallel to the sliding surface 24*c* and the supporting surface 24*a*.

Figure 7A:
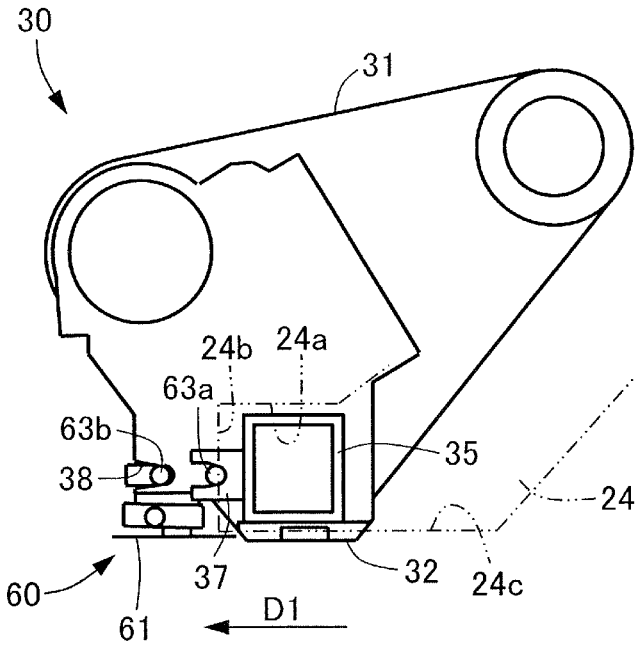
FIG. 7A is a side view illustrating the heating unit positioned at a contact start position in a state where the heating unit is attached to a casing according to the first embodiment.
Figure 7B:
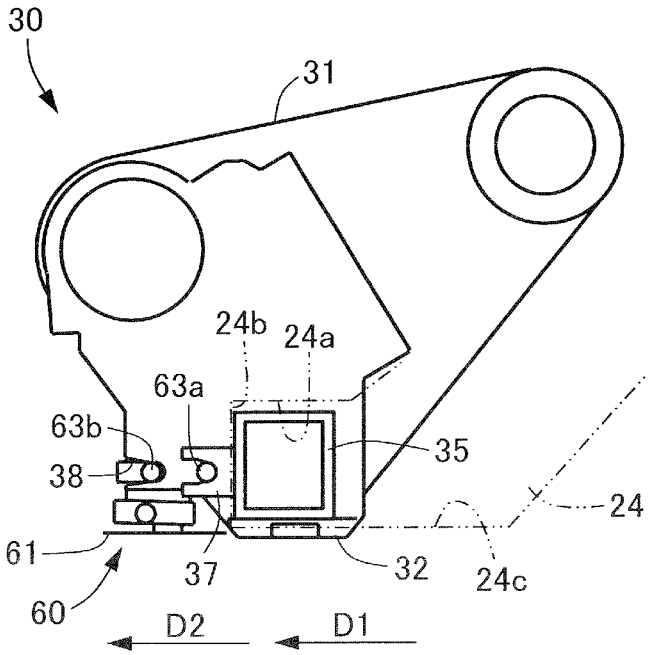
FIG. 7B is a side view illustrating the heating unit positioned at an attachment position in a state where the heating unit is attached to the casing according to the first embodiment.

As illustrated in FIG. 7A, the position of the heating unit 30 in a state where the stay 35 of the heating unit 30 is inserted to the guide portion 24 and guided by the sliding surface 24*c* and where the first separation positioning portion 37 and the first guide shaft 63*a* first abut against each other is set as the contact start position. Further, the position of the separation plate 61 in this state is set as the movement start position, i.e., second position. Further, the heating unit 30 does not contact the separation unit 60 until the heating unit 30 reaches the contact start position from the guide start position. As illustrated in FIG. 7B, the position of the heating unit 30 in a state where the heating unit 30 is moved to a state where the stay 35 is abutted against the positioning surface 24*b* and the heating unit 30 is fixed to the fixing unit 20 is set as the attachment position. The position of the separation plate 61 in this state is set as the fixed position, i.e., first position. The line that connects a locus of the first guide shaft 63*a* between the movement start position and the fixed position at this time is the direction of movement of the separation plate 61, and this direction is referred to as a separation plate insertion direction D2. That is, the separation plate 61 can move between the fixed position and the movement start position. The fixed position of the separation plate 61 is a position where the separation plate 61 is placed adjacent to or in contact with the fixing belt 31 to separate the sheet S having passed through the fixing nip portion N from the fixing belt 31 in a state where the heating unit 30 is positioned at the attachment position. Further, the movement start position of the separation plate 61 is a position where the separation plate 61 is separated from the fixed position in a state where the heating unit 30 is withdrawn from the casing 21. Furthermore, the tension spring 65 urges the separation plate 61 from the fixed position to the movement start position.

In a state where the heating unit 30 is attached to the casing 21, the stay 35 of the heating unit 30 is inserted to the guide portion 24. As illustrated in FIG. 7A, in a state where the heating unit 30 is positioned at the contact start position and comes into contact with the separation unit 60, the separation plate 61 is moved by being pushed toward the heating unit insertion direction D1 against urging force of the tension spring 65 urging the separation plate 61 to the movement start position. Thereby, the separation plate 61 is pushed toward the separation plate insertion direction D2, and the heating unit 30 is moved integrally with the separation plate 61. That is, the separation plate 61 is guided by the guide portion 24 in a state where the heating unit 30 is in contact with a portion of the separation unit 60 when the heating unit 30 is attached to the casing 21. Thereby, the separation plate 61 is moved by the heating unit 30 from the movement start position to the fixed position against the urging force of the tension spring 65. Thereby, the separation plate 61 moves while maintaining an appropriate interval with the heating unit 30. In a state where the stay 35 contacts the positioning surface 24*b*, the heating unit 30 is positioned at the attachment position, the separation plate 61 is positioned at the fixed position, and the heating unit 30 is fixed by a fixing portion not shown.

Meanwhile, in a state where the heating unit 30 is removed from the casing 21, the fixing portion not shown is released, and the heating unit 30 is drawn out from the attachment position toward the contact start position. The separation plate 61 is urged by the tension spring 65 and moved from the fixed position to the movement start position. In a state where the heating unit 30 passes the contact start position, the first guide shaft 63*a* contacts the guide groove 64*a* (refer to FIG. 5), and the separation plate 61 remains stopped at the movement start position. Thereafter, the heating unit 30 is removed completely from the guide portion 24 and taken out of the casing 21.

According to the present embodiment, a case where the direction of movement of the separation unit 60 is linear and the separation unit 60 moves in a straight line is described, but the present invention is not limited thereto, and the direction of movement can be curved and the separation unit 60 may be moved in pivoting motion. Further according to the present embodiment, the first guide shaft 63*a* is abutted against the first separation positioning portion 37, but the present invention is not limited thereto, and for example, the shaft and hole can be formed oppositely, or the shaft can be formed as a different component. Moreover, a configuration can be adopted where the separation unit 60 is in contact with the pressure pad 32 or the unit side plate 36 in response to the required accuracy, according to which an equivalent effect can be achieved. Here, the first separation positioning portion 37 and the second separation positioning portion 38 compose a separation unit movement mechanism. The separation unit movement mechanism is configured to move the separation unit 60 from the movement start position to the fixed position with the heating unit 30 mounting to the position to form the fixing nip portion N.

Figure 8A:
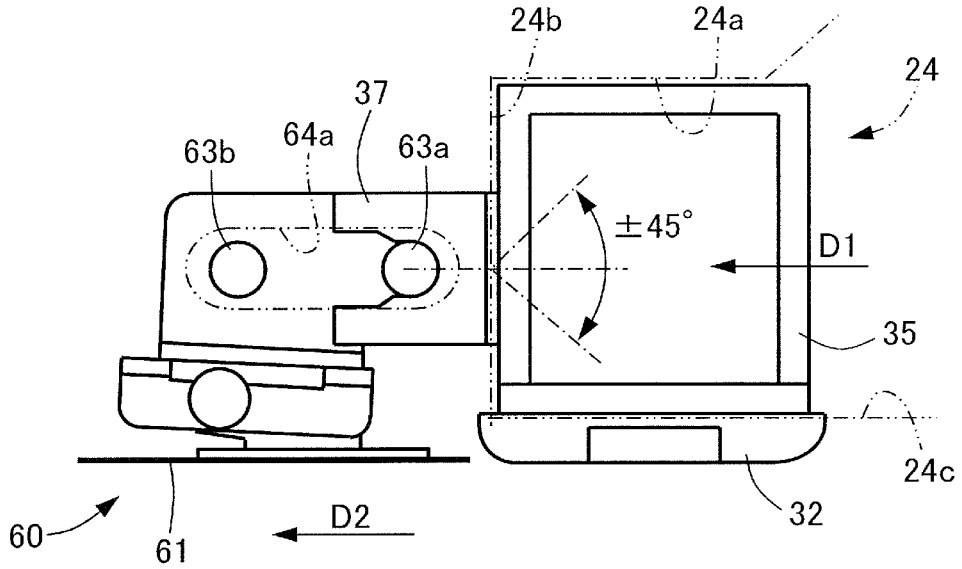
FIG. 8A is a side view illustrating a contact portion between the heating unit and the separation unit according to the first embodiment.
Figure 8B:
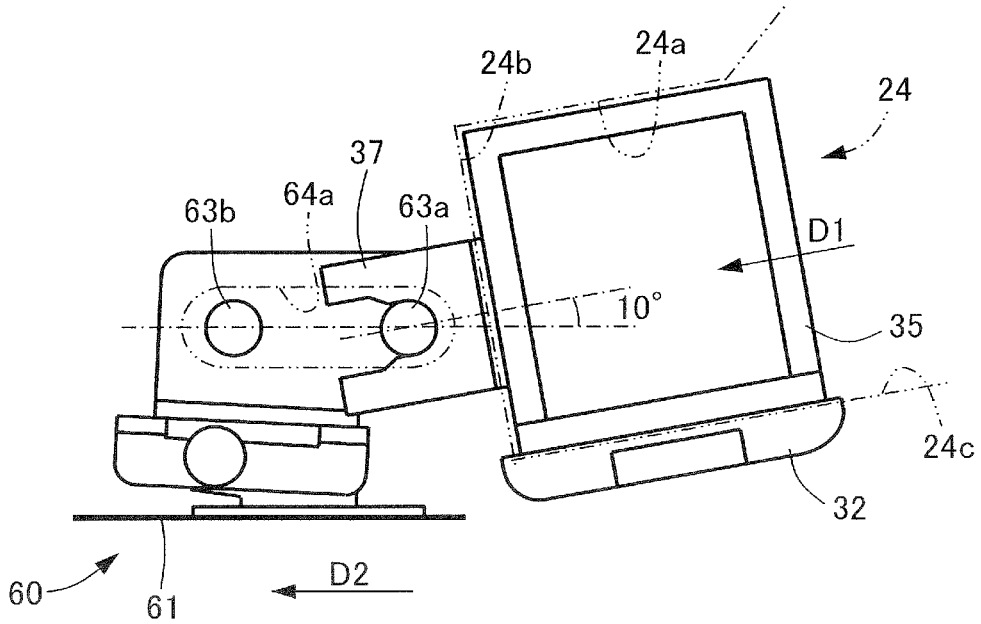
FIG. 8B is a side view illustrating a contact portion between a heating unit and a separation unit according to a modification example.

FIGS. 8A and 8B are views illustrating a relative angle of the heating unit insertion direction D1 and the separation plate insertion direction D2, wherein FIG. 8A illustrates a state where the relative angle is 0° according to the present embodiment, and FIG. 8B illustrates a state where the relative angle is 10° according to a modification example According to the present embodiment, as illustrated in FIG. 8A, the heating unit insertion direction D1 and the separation plate insertion direction D2 are arranged horizontally along the sheet conveyance direction, and the relative angle is set to 0°. If the range of the relative angle is set to fall within ±45°, as illustrated in FIG. 8B, an effect similar to the case where the relative angle is 0° can be achieved. In contrast, if the range of the relative angle formed by the direction D1 and the direction D2 exceeds ±45° when moving the separation unit 60 by the stay 35, the sliding resistance between the first guide shaft 63*a* and the guide groove 64*a* when inserting the heating unit 30 becomes excessive, and ease of assembly may be deteriorated. Further, it may lead to damaging of the sliding portion. Therefore, the range of the relative angle should preferably fall within ±45°. That is, according to the present embodiment, the movement path of the separation plate 61 between the fixed position and the movement start position is linear when viewed in the width direction W. The guide portion 24 either guides the heating unit 30 in the same direction as the direction of movement of the separation plate 61, or guides the heating unit 30 at an inclination angle of 45 degrees or smaller with respect to the direction of movement of the separation plate 61.

Figure 9A:
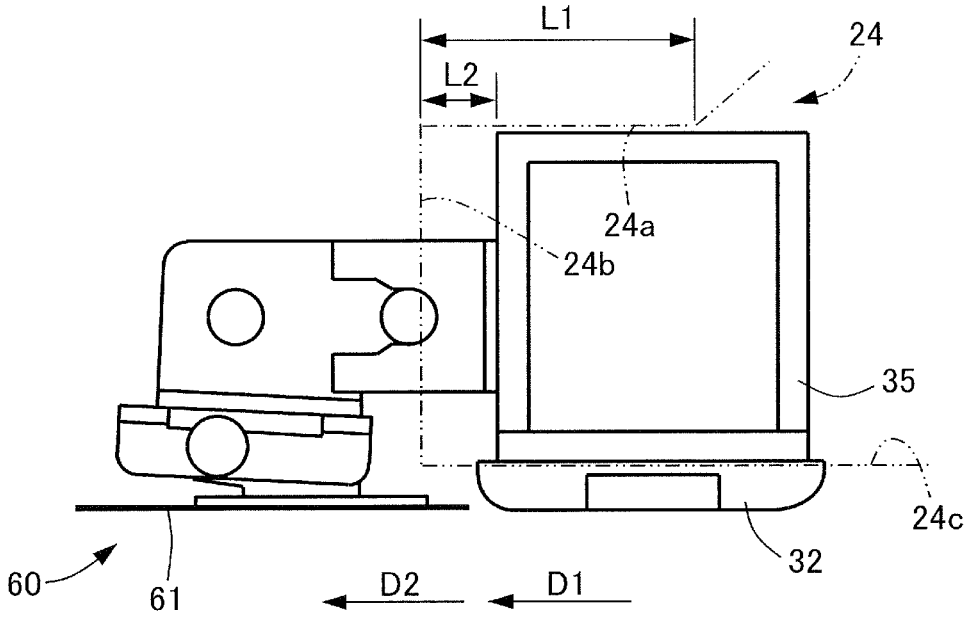
FIG. 9A is a side view illustrating the contact portion between the heating unit and the separation unit positioned at the contact start position in a state where the heating unit is attached to the casing according to the first embodiment.
Figure 9B:
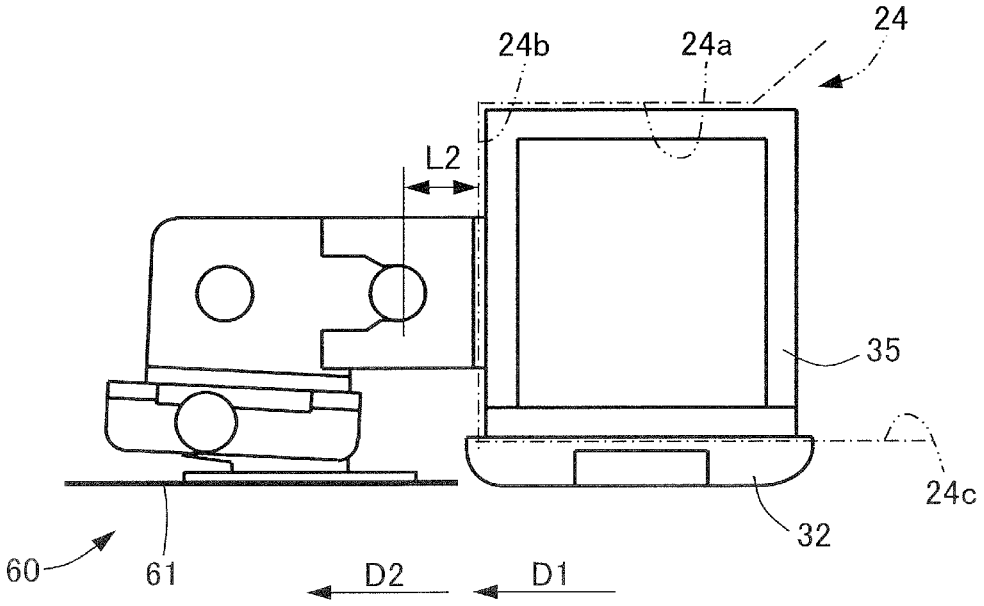
FIG. 9B is a side view illustrating the contact portion between the heating unit and the separation unit positioned at the attachment position in a state where the heating unit is attached to the casing according to the first embodiment.

Regulation Distance of Insertion and Removal of Heating Unit and Swing Distance of Separation Plate Next, a regulation distance of insertion and removal of the heating unit 30 and a distance of movement of the separation plate 61 will be described in detail with reference to FIGS. 9A and 9B. Here, the length of the heating unit insertion direction D1 of the supporting surface 24*a* is denoted as L1, and the distance of the heating unit insertion direction D1 in a state where the separation plate 61 is swung from the movement start position (FIG. 9A) to the fixed position (FIG. 9B) described earlier by attaching or detaching the heating unit 30 is denoted as L2. In this case, a configuration where L1>L2 is realized is preferable in order to enable the separation plate 61 to remain attached when removing or attaching the heating unit 30. Therefore, the distance L1 in which the heating unit 30 is guided toward the heating unit insertion direction D1 by the guide portion 24 should at least be distance L2 from the positioning surface 24*b*. Thereby, when attaching the heating unit 30 to the guide portion 24, the heating unit 30 is in contact with a part of the separation unit 60 during movement after it is started to be guided from the contact start position to the attachment position. Therefore, there is no need to insert the separation unit 60 in advance, and the workability can be improved.

As described above, according to the fixing unit 20 of the present embodiment, when the heating unit 30 is attached to the casing 21, the separation unit 60 is guided by the guide portion 24 in a state where the heating unit 30 is in contact with the separation unit 60. Thereby, the separation unit 60 is moved by the heating unit 30 from the movement start position to the fixed position against the urging force of the tension spring 65. Therefore, the heating unit 30 can be attached without interfering with the separation plate 61 and without performing any special operation other than the attaching movement, without having to use a jig for retreating the separation plate 61 when attaching the heating unit 30 to the casing 21. Therefore, the number of components and the processing steps can be suppressed without deteriorating the positioning accuracy of the separation plate 61 to the heating unit 30.

Second Embodiment

Next, a second embodiment of the present invention will be described in detail with reference to FIGS. 10 to 12B and 14. The present embodiment differs from the first embodiment in that a separation unit 160 of a fixing unit 120 includes a contact member 169 serving as a contact portion that comes in direct contact with a fixing belt 131 and moves a separation plate 61. The other configurations are similar to the first embodiment, so that equivalent components are denoted with the same reference numbers, and detailed descriptions thereof are omitted.

Figure 10:
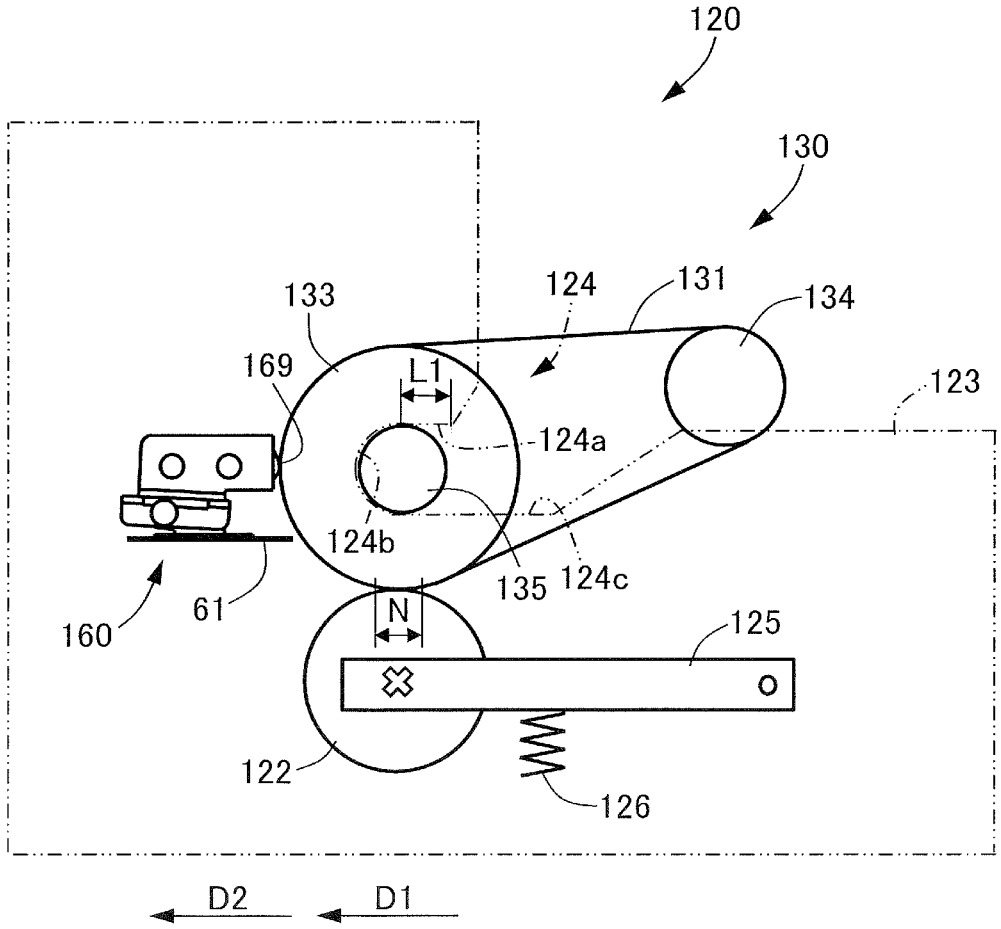
FIG. 10 is a cross-sectional view illustrating a fixing unit according to a second embodiment.

According to the present embodiment, as illustrated in FIG. 10, a heating unit 130 includes a fixing belt 131 having an endless shape and serving as a rotatable first rotary member, a heating roller 133, a steering roller 134, and a unit side plate not shown that integrates these components as a cartridge. The fixing belt 131 is stretched across the heating roller 133 and the steering roller 134. A halogen heater not shown is provided on an inner side of the heating roller 133. Further, a pressure roller 122 is arranged to oppose to the heating roller 133. The pressure roller 122 presses the fixing belt 131 against the heating roller 133 and forms the fixing nip portion N.

A fixing frame 123 includes a guide portion, i.e., first guide portion, 124, a pressurizing frame 125, and a pressurizing spring 126. A bearing, i.e., support member, 135 for supporting an end portion of the heating roller 133 is fit to the guide portion 124, and the heating roller 133 is positioned on the fixing frame 123. The guide portion 124 includes a supporting surface, i.e., supporting portion, 124*a*, a positioning surface, i.e., positioning portion, 124*b*, and a sliding surface 124*c*.

Figure 11:
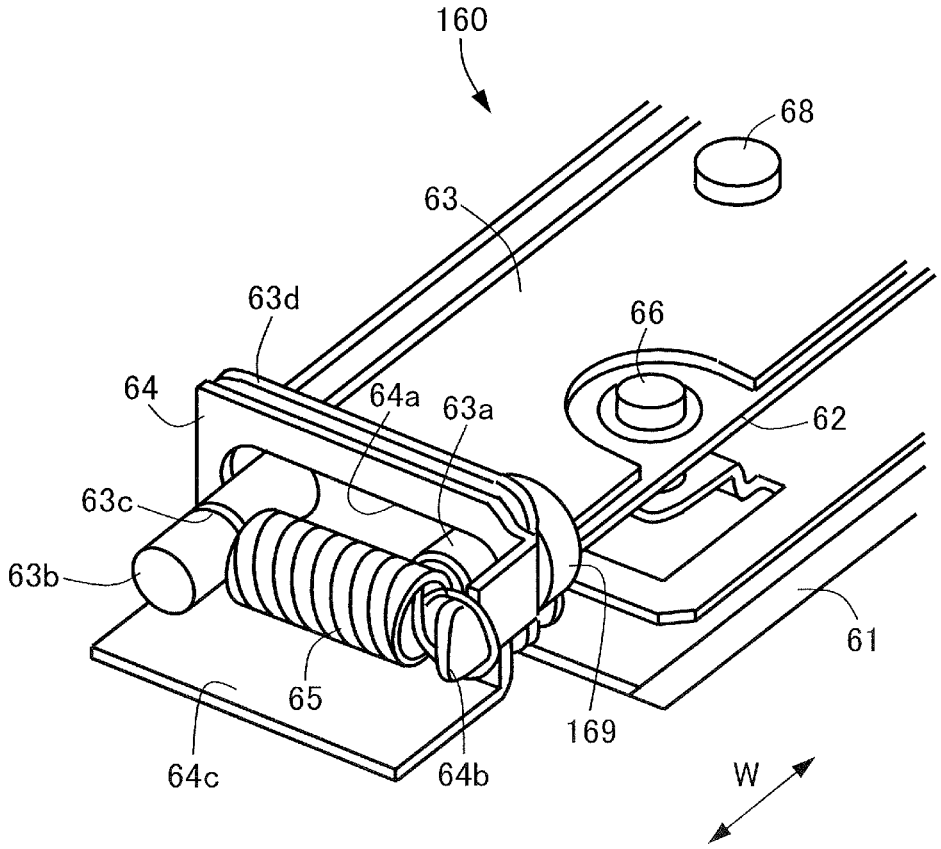
FIG. 11 is a perspective view illustrating a portion of a separation unit according to the second embodiment.

As illustrated in FIG. 11, a contact member 169 in contact with the fixing belt 131 is provided on the separation plate regulation member 63 of the separation unit 160. That is, the separation unit 160 includes the contact member 169 capable of being in contact with the fixing belt 131. The contact member 169 is disposed to be able to contact the fixing belt 131 wound around the heating roller 133 (refer to FIG. 10).

As illustrated in FIG. 10, when attaching the heating unit 130 to the casing 21 (refer to FIG. 3), the bearing 135 of the heating unit 130 is inserted to the guide portion 124. In a state where the heating unit 130 is positioned at the contact start position and is in contact with the contact member 169 of the separation unit 160, the separation plate 61 is pushed toward the heating unit insertion direction D1 and moved against the urging force of the tension spring 65 (refer to FIG. 11) urging the separation plate 61 toward the movement start position. That is, when the heating unit 130 is moved from the contact start position to the attachment position, the fixing belt 131 comes into contact with the contact member 169 and moves the separation unit 160, by which the separation unit 160 is moved from the movement start position to the fixed position. Thereby, the separation plate 61 is pressed toward the separation plate insertion direction D2, and the heating unit 130 moves integrally with the separation plate 61. When the bearing 135 contacts the positioning surface 124*b*, the heating unit 130 is positioned at the attachment position, the separation plate 61 is positioned at the fixed position, and the heating unit 130 is fixed by a fixing portion not shown.

Figure 12A:
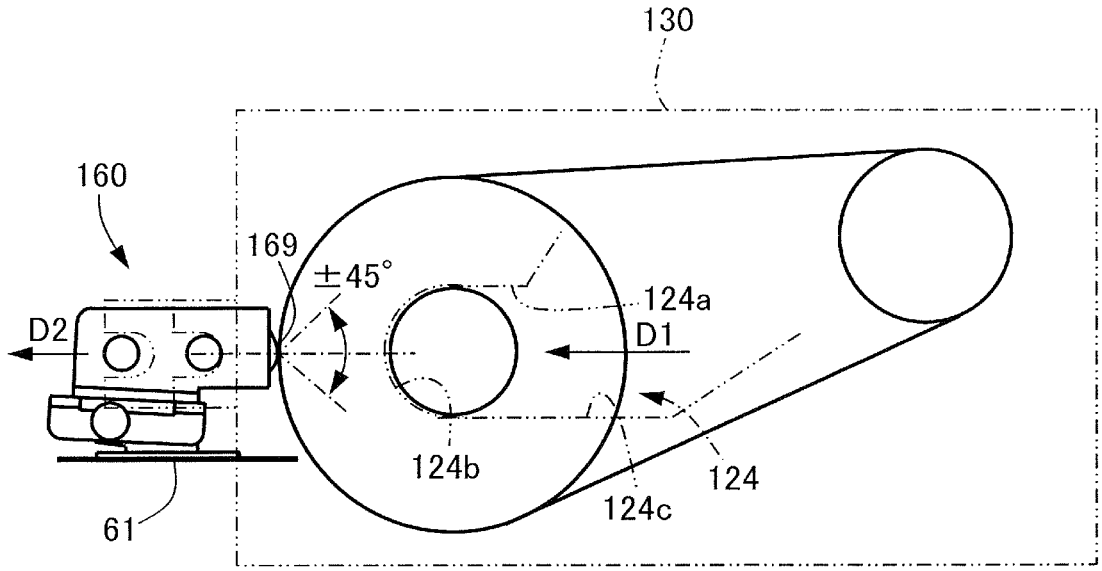
FIG. 12A is a side view illustrating a contact portion between a heating unit and a separation unit according to the second embodiment.
Figure 12B:
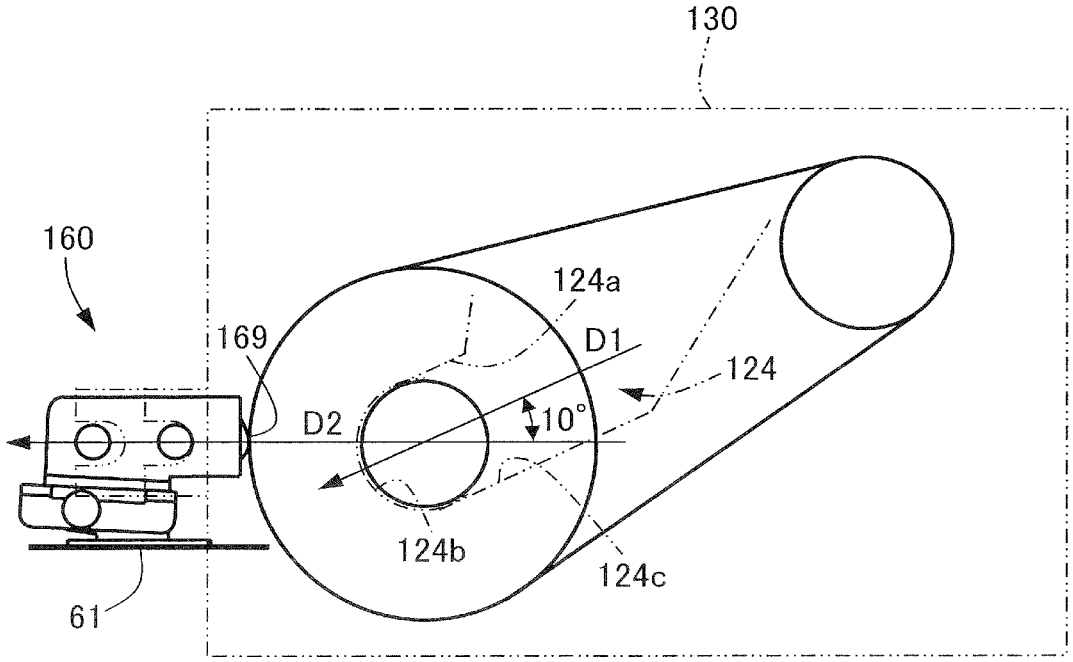
FIG. 12B is a side view illustrating a contact portion between a heating unit and a separation unit according to a modification example.

FIGS. 12A and 12B illustrate relative angles of the heating unit insertion direction D1 and the separation plate insertion direction D2, wherein FIG. 12A illustrates a case where the relative angle is 0° according to the present embodiment, and FIG. 12B illustrates a case where the relative angle is 10° according to a modification example. In the present embodiment, as illustrated in FIG. 12A, the heating unit insertion direction D1 and the separation plate insertion direction D2 are arranged horizontally along the sheet conveyance direction, and the relative angle is set to 0°. If the range of the relative angle is set to fall within ±45°, as illustrated in FIG. 12B, an effect similar to the case where the relative angle is 0° can be achieved. In contrast, if the range of the relative angle formed by the direction D1 and the direction D2 exceeds ±45° when moving the separation unit 160 by the bearing 135, the sliding resistance between the first guide shaft 63*a* and the guide groove 64*a* when inserting the heating unit 130 becomes excessive, and ease of assembly may be deteriorated. Further, it may lead to damaging of the sliding portion. Therefore, the range of the relative angle should preferably fall within ±45°.

As described, according to the fixing unit 120 of the present embodiment, when the heating unit 130 is attached to the casing 21, the separation unit 160 is guided by the guide portion 124 in a state where the heating unit 130 is in contact with the separation unit 160. Thereby, the separation unit 160 is moved by the heating unit 130 from the movement start position to the fixed position against the urging force of the tension spring 65. Therefore, the heating unit 130 can be attached without interfering with the separation plate 61 and without performing any special operation other than the attaching movement, without having to use a jig for retreating the separation plate 61 when attaching the heating unit 130 to the casing 21. Therefore, the number of components and the processing steps can be suppressed without deteriorating the positioning accuracy of the separation plate 61 to the heating unit 130.

Figure 14:
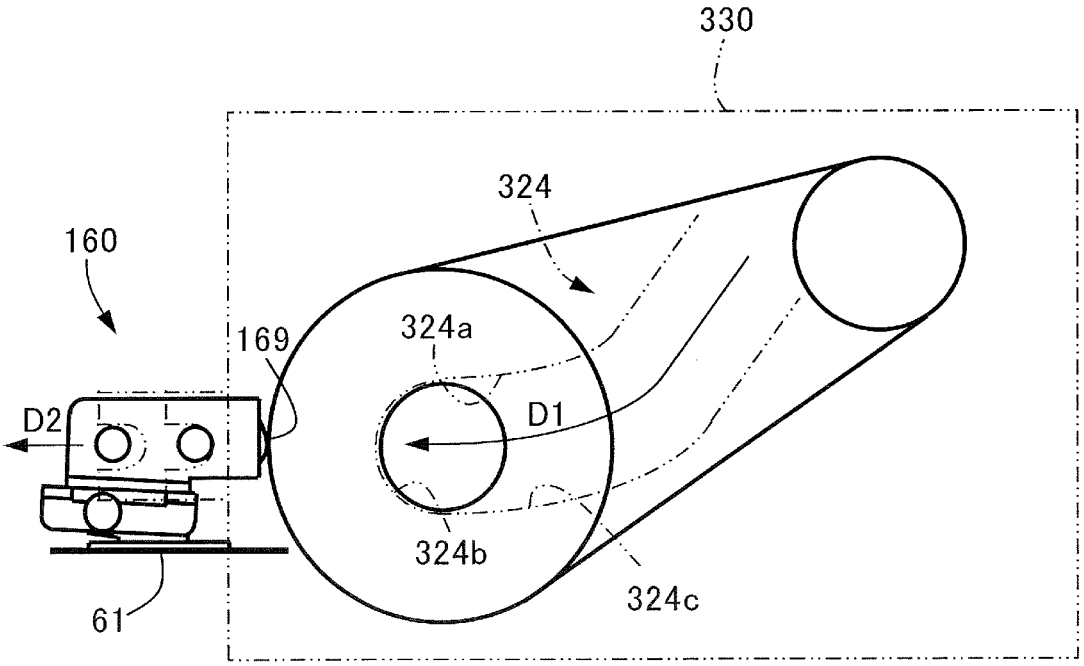
FIG. 14 is a side view illustrating a contact portion between a heating unit and a separation unit according to a modified example of the second embodiment.

According to the present embodiment, a case where the direction of movement of the separation unit 160 is linear and the separation unit 160 moves in a straight line is described, but the present invention is not limited thereto, and the direction of movement can be curved and the separation unit 160 may be moved in pivoting motion. For example, as illustrated in FIG. 14, a guide portion, i.e., first guide portion, 324 may include a supporting surface, i.e., supporting portion, 324*a*, a positioning surface, i.e., positioning portion, 324*b* and a sliding surface 324*c*, and the whole body of the guide portion 324 can be protruded downward in a curved shape. In that case, a heating unit 330 can be guided along a curved guide portion 324 from the guide start position via the contact start position to the attachment position.

Third Embodiment

Next, a third embodiment of the present invention will be described in detail with reference to FIGS. 13A and 13B. The present embodiment differs from the first embodiment in that a fixing unit 220 is provided outside the image forming apparatus 1. The other configurations are similar to the first embodiment, so that equivalent components are denoted with the same reference numbers, and detailed descriptions thereof are omitted.

Figure 13A:
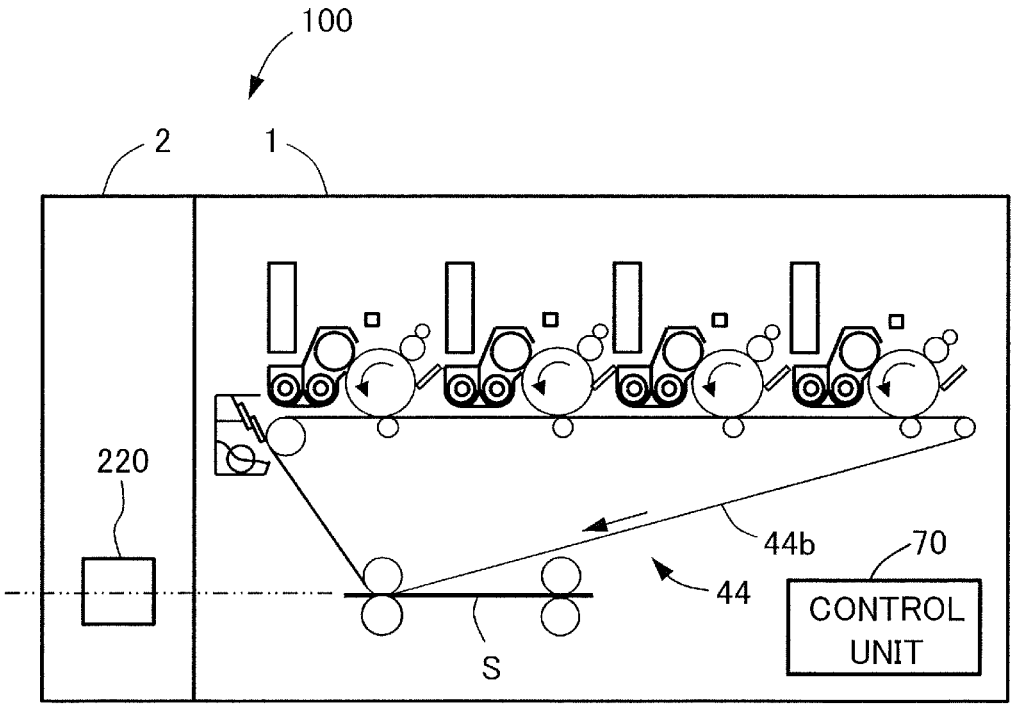
FIG. 13A is a cross-sectional view illustrating an overall configuration of a state where a fixing unit is attached to an image forming apparatus according to an image forming apparatus of a third embodiment.
Figure 13B:
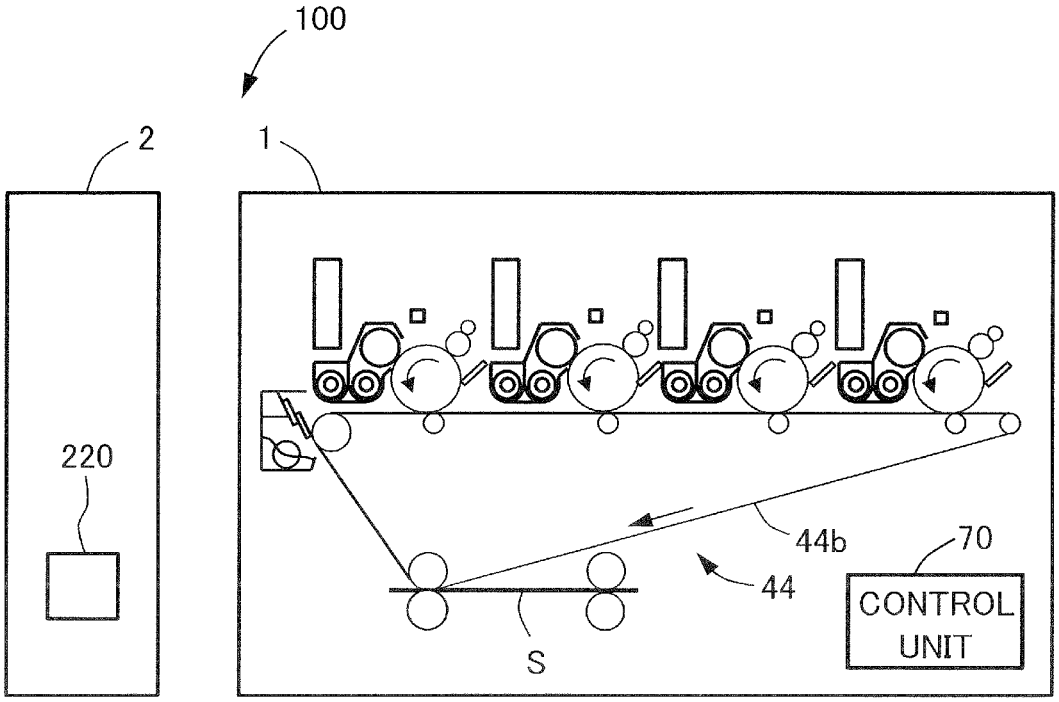
FIG. 13B is a cross-sectional view illustrating an overall configuration of a state where the fixing unit is detached from the image forming apparatus according to the image forming apparatus according to the third embodiment.

According to the present embodiment, as illustrated in FIG. 13A, an image forming system 100 is composed of the image forming apparatus 1 including the intermediate transfer belt 44*b*, and a post-processing apparatus 2 serving as a sheet processing apparatus and including the fixing unit 220 and subsequent processing components. The post-processing apparatus 2 includes the fixing unit 220 that fixes the unfixed toner image formed in the image forming apparatus 1 to the sheet S. The fixing unit 220 adopts a similar configuration as the fixing units 20 and 120 of the first and second embodiments described above. In the image forming system 100, when replacing the fixing unit 220 of the post-processing apparatus 2, as illustrated in FIG. 13B, the post-processing apparatus 2 is removed from the image forming apparatus 1. Then, the heating unit inside the fixing unit 220 can be attached and detached in a space formed between the post-processing apparatus 2 and the image forming apparatus 1.

As described, according to the fixing unit 220 of the present embodiment, the replacement operation of the heating unit can be realized without drawing out the fixing unit 220 to the front direction in the post-processing apparatus 2. Therefore, the structure of the post-processing apparatus 2 can be simplified.

According to the embodiments described above, a case where a fixing belt has been adopted as the first rotary member has been described, but the present invention is not limited thereto, and other configurations such as a fixing roller can be adopted. Further, a case where the pressure roller has been adopted as the second rotary member has been described, but the present invention is not limited thereto, and other configurations such as a pressurizing belt can be adopted.

The present embodiments enable to suppress the number of components and processing steps without deteriorating the positioning accuracy of the separation member on the heating unit.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-008760, filed Jan. 22, 2019, which is hereby incorporated by reference herein in its entirety.

What is claimed is:

1. An image forming apparatus comprising:

a first rotary member configured to heat an unfixed toner image formed on a recording material;

a second rotary member configured to contact the first rotary member and form a fixing nip portion with the first rotary member for conveying the recording material;

a separation unit comprising a separation plate and a positioning portion, the separation plate being provided without contact with the first rotary member and configured to separate the recording material from the first rotary member, the positioning portion being configured to position the separation plate with respect to the first rotary member; and a guide configured to guide attaching/detaching of the first rotary member with respect to the image forming apparatus, wherein the guide has a guide portion configured to guide a movement of the first rotary member in a direction that is toward an upstream side of a conveyance direction of the recording material, and wherein a relative position of the separation plate with respected to the first rotary member when the recording material passes through the fixing nip portion and a relative position of the separation plate with respected to the first rotary member when the first rotary member is started to be guided by the guide portion to detach the first rotary member from the image forming apparatus are the same.

2. The image forming apparatus according to claim 1, further comprising a supporting unit configured to support the first rotary member.

3. The image forming apparatus according to claim 2, wherein the supporting unit is configured to be detached from the image forming apparatus in a state where the second rotary member is supported by the image forming apparatus.

4. The image forming apparatus according to claim 3, wherein the positioning portion is configured to engage with the supporting unit.

5. The image forming apparatus according to claim 2, further comprising a supporting unit positioning portion configured to engage with the supporting unit and position the supporting unit with respect to the image forming apparatus.

6. The image forming apparatus according to claim 2, further comprising a spring configured to urge the separation plate toward the supporting unit.

7. The image forming apparatus according to claim 2, wherein the first rotary member is a belt member, further comprising a pad configured to press the second rotary member through the belt member.

8. The image forming apparatus according to claim 2, wherein the guide portion is configured to guide the supporting unit to a guide end position where a guide of the supporting unit by the guide portion ends from a guide starting position where the guide of the supporting unit by the guide portion starts, and wherein the positioning portion is configured to engage with the supporting unit in a case the supporting unit is guided from the guide starting position to an intermediate position between the guide starting position and the guide end position.

9. The image forming apparatus according to claim 1, wherein the direction in which the guide portion guides the first rotary member is a substantially horizontal direction.

10. The image forming apparatus according to claim 9, wherein the guide comprises a first guide portion and a second guide portion, wherein the first guide portion is the guide portion, and wherein the second guide portion is connecting with an upstream side end portion of the first guide portion in the conveyance direction and is inclined to be further upward in a vertical direction as the second guide portion extends upstream in the conveyance direction.

11. The image forming apparatus according to claim 1, wherein the first rotary member is a belt member.

12. The image forming apparatus according to claim 11, wherein the belt member is stretched across a plurality of rollers.

13. The image forming apparatus according to claim 1, wherein the guide portion is configured to guide the movement of the first rotary member in a direction orthogonal to a rotational axis of the first rotary member, in a case that the first rotary member is detached from the image forming apparatus.

14. The image forming apparatus according to claim 13, wherein the guide portion is configured to guide the movement of the first rotary member upward in a vertical direction, in the case that the first rotary member is detached from the image forming apparatus.

15. The image forming apparatus according to claim 1, wherein when the first rotary member is started to be detached from the image forming apparatus, an angle between the separation plate and the direction in which the guide portion guides the first rotary member is within 45 degrees.

16. The image forming apparatus according to claim 1, wherein the first rotary member is configured to be detached from the image forming apparatus in a state where the separation unit is supported by the image forming apparatus.

17. An image forming apparatus comprising:

a first unit including a first rotary member configured to heat an unfixed toner image formed on a recording material;

a second unit including a second rotary member configured to contact the first rotary member and form a fixing nip portion with the first rotary member for conveying the recording material;

a separation unit comprising a separation plate and a positioning portion, the separation plate being provided without contact with the first rotary member and configured to separate the recording material from the first rotary member, the positioning portion being configured to position the separation plate with respect to the first rotary member; and a guide configured to guide attaching/detaching of the first rotary member with respect to the image forming apparatus, wherein the guide has a guide portion configured to guide a movement of the first rotary member in a direction that is toward an upstream side of a conveyance direction of the recording material, and wherein the first rotary member is configured to be detachable from the image forming apparatus by being guided by the guide portion without performing an operation for retracting the separation unit from the first rotary member.

18. The image forming apparatus according to claim 17, wherein the positioning portion is configured to engage with the first unit.

19. The image forming apparatus according to claim 17, further comprising a first unit positioning portion configured to engage with the first unit and position the first unit with respect to the image forming apparatus.

20. The image forming apparatus according to claim 17, further comprising a spring configured to urge the separation plate toward the first rotary member, and a separation plate supporting portion configured to support the separation plate slidably in a predetermined direction, wherein the predetermined direction is a direction in which the guide portion guides the first rotary member substantially.

21. The image forming apparatus according to claim 17, wherein the first rotary member is a belt member.

22. The image forming apparatus according to claim 17, wherein when the first rotary member is started to be removed from the image forming apparatus, an angle between the separation plate and the direction in which the guide portion guides the first rotary member is within 45 degrees.

23. The image forming apparatus according to claim 17, wherein the first rotary member is configured to be detached from the image forming apparatus in a state where the separation unit is supported by the image forming apparatus.

24. The image forming apparatus according to claim 17, wherein the guide portion is configured to guide the first unit to a guide end position where a guide of the first unit by the guide portion ends from a guide starting position where the guide of the first unit by the guide portion starts, and wherein the positioning portion is configured to engage with the first unit in a case the first unit is guided from the guide starting position to an intermediate position between the guide starting position and the guide end position.

* * * * *